United States Patent [19]

Lycan

[11] Patent Number: 4,894,497

[45] Date of Patent: Jan. 16, 1990

[54] HIGH TEMPERATURE PRESSURE SWITCH ASSEMBLY FOR USE WITH EXPLOSION-PROOF ENCLOSURES

[75] Inventor: Jennings Lycan, Huntington, W. Va.

[73] Assignee: Service Machine Company, Huntington, W. Va.

[21] Appl. No.: 308,141

[22] Filed: Feb. 8, 1989

[51] Int. Cl.[4] ..... H01H 35/34

[52] U.S. Cl. ..... 200/83 R; 200/144 R; 340/544

[58] Field of Search ..... 73/35; 361/37, 334; 337/320; 307/118; 200/144 R, 293, 302.1, 306, 82 R, 82 C, 83 R, 83 J, 83 A, 83 T, 83 Y, 61.5, 318, 320–322, 83 Q; 340/544, 611, 626

[56] References Cited

U.S. PATENT DOCUMENTS

| | | | |
|---|---|---|---|
| 3,378,657 | 4/1968 | Smith | 200/834 |
| 3,433,911 | 3/1969 | Jensen | 200/83 R |
| 3,535,878 | 10/1970 | Romanowski | 200/83 R |
| 3,717,734 | 2/1973 | Wertheimer | 200/83 R |
| 4,225,760 | 9/1980 | Griffith | 200/83 R |
| 4,317,971 | 3/1982 | Roth | 200/82 C |

FOREIGN PATENT DOCUMENTS

| | | | |
|---|---|---|---|
| 1165667 | 10/1969 | United Kingdom | 200/83 R |

*Primary Examiner*—Gerald P. Tolin

*Attorney, Agent, or Firm*—McCaleb, Lucas & Brugman

[57] ABSTRACT

A high temperature pressure switch assembly for an explosion-proof enclosure used in hazardous atmospheres comprises an electrical control switch for a remote power source supplying electrical power to the enclosure, and a pressure responsive member which actuates the control switch to disconnect the power source in response to a small but abrupt pressure rise within the enclosure which indicates an explosion, severe electrical arcing or insulation pyrolysis therewithin.

13 Claims, 3 Drawing Sheets

HIGH TEMPERATURE PRESSURE SWITCH ASSEMBLY FOR USE WITH EXPLOSION-PROOF ENCLOSURES

BACKGROUND OF THE INVENTION

In coal mining, electrical control equipment is generally located near the working coal face. Such electrical equipment must be located within a protective enclosure of "explosion-proof" design to prevent electrical sparks or arcs from igniting any explosive mixture of methane and air which may be found in the area. In addition, methane monitors sense the presence of methane in the general atmosphere and shut off the power if a safe threshold level is exceeded. The mine ventilation system ideally also prevents an accumulation of methane gas which would be sufficient to cause an explosion. Short circuit protective devices are designed to prevent the occurrence of a prolonged arc. Such safety measures provide redundant protection, so that if one or even two should fail, there is still some degree of safety to depend upon.

Each of these presently used methods of protection has some mode of failure. For example, methane monitors are subject to being tampered with and hence disabled in various ways. Short circuit protective devices sometimes fail to interrupt faults which cause arcing. The high temperature pressure switch assembly of the present invention offers an additional approach to ensuring safety in hazardous locations, the need for which will be described in further detail in the following paragraphs.

These explosion-proof enclosures are of very rugged construction as a result of strictly controlled design criteria, and are government tested at a specified pressure level. Presently, enclosures must be designed and built to withstand an inside static pressure of 150 psig, and incorporate typically ½ inch thick walls. Flame-quenching joints are provided typically by 1 inch flange widths, and 0.004 inch maximum flange gaps. The enclosure must retain its explosion-proof qualities after being subjected to a battery of internal pressures.

Testing has shown that although it is unlikely, methane can leak into the interior of an enclosure, and result in an explosive mixture of methane and air, even where the gap between the enclosure flange and its cover is very small. A normally occurring spark can ignite these gases. Fundamental to the requirement that the enclosures be of "explosion-proof" design is that any internal ignition or explosion must be contained within the enclosure and must not propagate to an external explosive atmosphere.

In addition to the occurrences of explosions inside the enclosure, other significant sources of atmospheric pressure increase exist, such as that resulting from the thermal effect of a persistent electrical arc, and that from chemical pyrolysis of the electrical insulating material.

The magnitudes of pressures which may occur inside an enclosure are related to the following:

1. The magnitude of pressure which can result from a persistent electrical arc is directly related to the power available in the circuit and the amount of "free volume" inside the enclosure. The thermal effects of an electrical arc which is not interrupted by the circuit protective device will cause the pressure to increase steadily over the fault duration.
2. Laboratory testing has demonstrated that an explosion of methane and air may produce a pressure of up to approximately 100 psig. The occurrence of such an explosion which is a result of an electrical arc as described above, may result in combined (additive) pressures in excess of the pressure holding capability of the enclosure.
3. Pyrolysis is a chemical decomposition of electrical insulation material. Where the insulation material between terminals is contaminated with dust or moisture, a phenomenon called "tracking" occurs. Voltage stresses cause minute amounts of current to flow along the insulation surface. These currents gradually increase (over a long period), and some erosion of the insulation material may occur. If the circuit protective device fails to sense the fault, the process eventually reaches a point where a power arc is established along the surface of the insulation material. The intense heat from the arc causes chemical decomposition of certain widely used insulation materials (such as phenolic resins) and the generation of large quantities of various flammable or toxic gases, including highly explosive hydrogen. In a closed vessel such as an explosion-proof enclosure these gases cannot escape and very high pressures (much higher than the 150 psig design strength) can be developed. These severe pressure increases can be prevented if the power is quickly shut off when the pressure is just beginning to rise.

Very high temperatures can be expected in an enclosure from a methane explosion, an electrical arc, or pyrolysis of electrical insulation. This has discouraged development of pressure-sensing switches, prior to the present invention, because of the widespread belief that they would not operate properly at the high temperatures. For example, a February 1986 mining research contract report, "Development of High Voltage Permissible Load Center", summarizing a 5-year research effort by Foster-Miller, Inc., stated, > "the major disadvantage of pressure sensors was that we were unable to find one which would be certain of operating properly at the elevated temperatures which might also be expected."

Coal mining technology continues to advance rapidly and the power requirements of mining machines continues to increase. Motor sizes have increased and so have utilization voltages. As the capacity of power systems increase, it becomes more likely that pressures occurring in enclosures resulting from explosions, arcing or pyrolysis may be greater than the presently required 150 psig design capacity. In addition, higher utilization voltages increase the likelihood of tracking failures causing chemical pyrolysis. Properly installed inside an explosion-proof enclosure, the high temperature pressure switch assembly of the present invention can trip a remote circuit breaker, thus cutting off the power supply to the enclosure. This pressure switch assembly satisfies the need to maintain, or even possibly increase the degree of safety by diminishing the chances of enclosure failure due to excessive pressures, despite these upward trends in motor sizes and utilization voltages.

OBJECTS OF THE INVENTION

It is a primary object of the present invention to provide a high temperature safety switch assembly which will not be adversely affected by normal heat load of the internal component(s) operating at full power, and which will operate reliably in the additional heat incidental to a methane explosion, an electrical arc, or pyrolysis of electrical insulating material.

Basic requirements for a high temperature pressure switch assembly according to the present invention are summarized below:

1. The high temperature pressure switch assembly must be sensitive to sudden, but relatively low increases in atmospheric pressure, and its response time must be fast enough to remove power from the circuit before the pressure inside the enclosure is at a critical level. In an experimental proving test of the pressure switch assembly of this invention it was placed inside an enclosure containing a stoichiometric mixture of methane and air, which was ignited by an electric spark at a known instant. Pressure/time recordings indicated that the pressure switch assembly actuated on a pressure increase of less than one psig which occurred 0.035 seconds (2.1 cycles at 60 Hz) after ignition. The remote circuit breaker opened 0.050 seconds (3 cycles) after ignition, by which time the pressure had increased to only 10 psig.

(In the above test, the pressure did eventually rise to 94 psig inside the enclosure as a result of the ignition. This was because shutting off the power after ignition occurred could not stop the subsequent progressive ignition of gases surrounding the spark, and subsequent pressure increase. However, had an electrical arc occurred concurrently with the methane ignition, the heat dissipation and pressure rise due to the arc would have ceased when the power was shut off, hence preventing the additive effect of pressures resulting from the combined events of methane explosion and continuing electrical arc. Note: Methane explosions may be ignited by an electric arc resulting from a fault and, conversely, electric arcs may result from the dielectric breakdown of the atmosphere inside an enclosure resulting from the ionization of the atmosphere by methane combustion.)

2. The pressure switch assembly must be resistant to the possibly high temperatures and pressures encountered in explosions, electric arcs, and pyrolysis events. This depends upon the material of the diaphragm or other pressure-movable member, since it must deform or move under relatively low atmospheric pressure increases (hence, in the case of a diaphragm, it must be very thin). The actuating diaphragm 96 and the auxiliary, heat protective diaphragm 97 of the embodiment illustrated here are 5 mil DuPont "Kapton" plastics film. This material has a tensile strength of 24,000 psi at 23 degrees Centigrade, and a 400-degree Centigrade rating (2-hour test).
3. The pressure switch assembly must not be a cause of "nuisance" power outages, and hence must not be accidentally operated by vibration. The force required to actuate it must greatly exceed that which results from vibration, eliminating any such concerns.
4. The pressure switch assembly should not itself be a source of sparks or arcs, or introduce any new safety hazard to the electrical system. It can utilize either sealed contracts, which eliminate any incendive sparking when a signal is sent, or can be made explosion-proof itself.
5. The pressure switch assembly should be tamper-resistant, and not easily disabled. Its rugged construction (housing walls of this embodiment are nearly ½ inch thick) and double top cover with wide flange seals eliminate these concerns.
6. The pressure switch assembly should be of the "latching", or "manually resetting" type. Maintenance personnel must remove the cover of the enclosure and manually reset the pressure switch assembly before power can be restored to the circuit after it is shut off from its power supply, providing opportunity to investigate and correct the cause of a pressure increase which has tripped the switch.
7. The actuating diaphragm or other pressure-movable member should be of relatively large area to provide an effective operating force with a small pressure differential. In an embodiment tested, the diaphragm area was 7.07 square inches. A pressure of only 0.85 psig on the diaphragm provided approximately 6 pounds of force, which tripped the pressure switch assembly. Should the tripping-/latch mechanism become dirty or "sticky", tripping would require a slightly higher pressure. This ability to produce a large change in force in a very short time also gives the pressure switch an advantage over methane monitors which must be precisely calibrated to detect only a 2 percent concentration of methane.

GENERAL DESCRIPTION OF THE DRAWINGS

Other objects and advantages of the invention will be apparent from the accompanying drawings in which.

Like parts are referred to by like reference characters.

DETAILED DESCRIPTION OF THE PREFERRED EMBODIMENTS

Figure 1:
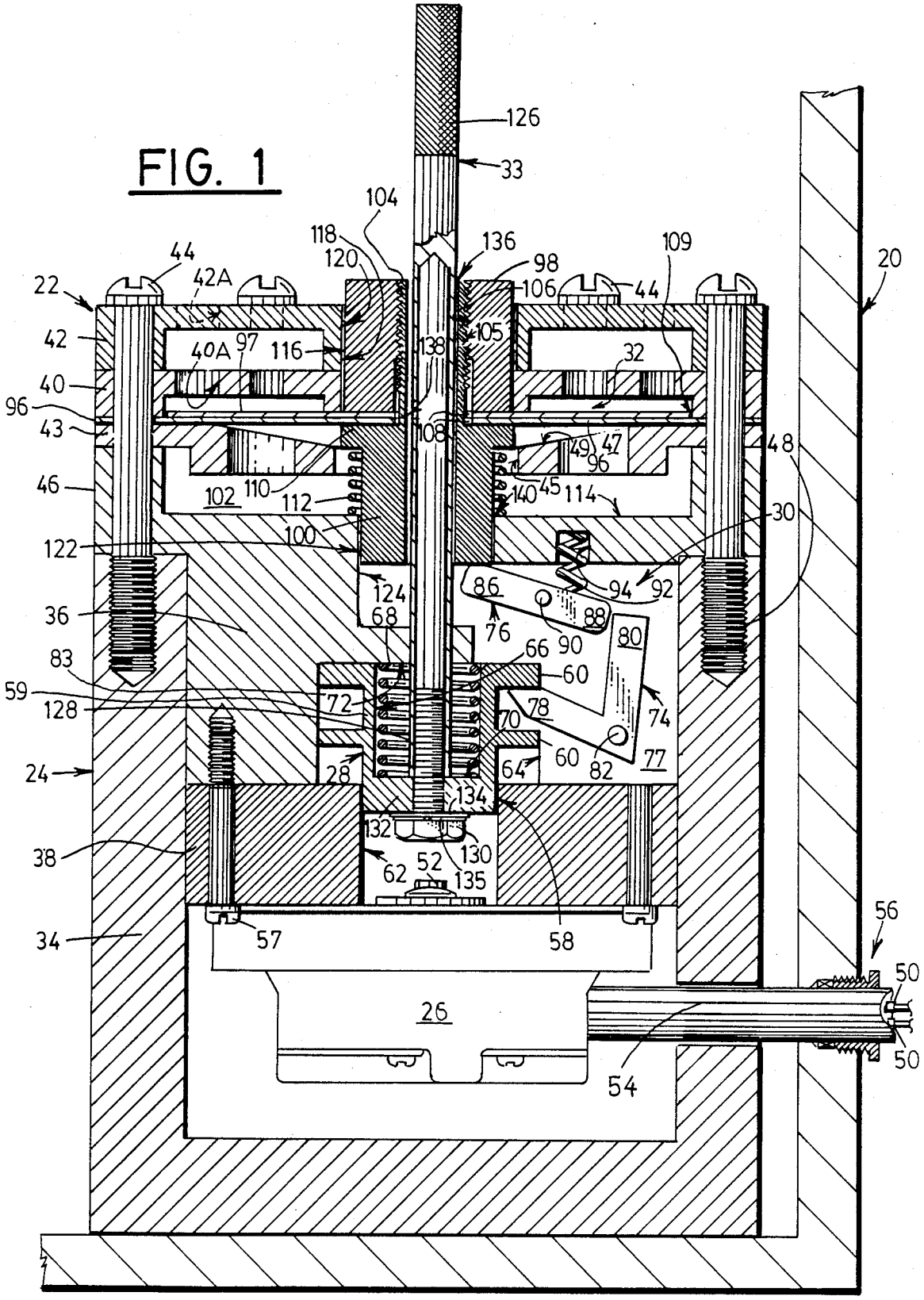
FIG. 1 is a longitudinal cross-sectional view of a high temperature pressure switch assembly showing a preferred form of the present invention positioned within an explosion-proof enclosure with a switch actuating mechanism shown locked in reset (untripped) position and a control switch in unactuated position.

Referring now in more detail to the embodiment shown in the drawings, an explosion-proof enclosure 20 is fragmentarily shown. It may contain a variety of electrical control equipment, such as relays, transformers and switches (not shown) for electrically powered equipment and may be located safely in a potentially hazardous atmosphere. Further, it typically will be supplied with electrical power through a remote circuit breaker (not shown).

A high temperature pressure switch assembly illustrating the present invention is generally designated 22. In general terms, it comprises the following main structural components and subcombinations:

a housing generally designated 24;
an electrical control switch 26;
a control switch actuating spool member 28;
latching mechanism generally designated 30;
a pressure responsive mechanism generally designated 32; and a reset rod 33.

The housing 24 consists of a main barrel-shaped portion 34, a control switch support member 36, a switch spacer member 38, a diaphragm support plate 43, and a pair of cover plates 40 and 42 with openings 40A and 42A which are offset to prevent tampering with or puncturing the internal components while allowing free ingress of air.

The housing components are assembled by bolts 44 extending through aligned peripheral openings in the cover plates 40 and 42, diaphragm support plate 43, and skirt 46 of control switch support member 36, and are screw-threaded at 48 into the upper end of the barrel-shaped portion 34.

The electrical control switch 26 may be any suitable normally open or normally closed switch connected through conductors 50 to a remote circuit breaker (not shown). Actuation of switch actuator button 52 either closes or opens a circuit, as required, through conductors 50 to shut off the power supply to the enclosure 20. For additional safety, the control switch 26 will preferably have sealed contacts, the conductors 50 will be taken through the wall of the explosion-proof enclosure by conventional means such as an explosion-proof cable gland or explosion-proof cable connector which is shown schematically at 56. Switch 26 may be secured to the bottom of spacer member 38 by any suitable means such as bolts (not shown). The spacer member 38 is secured by bolts 57 to the switch support member 36.

The control switch actuating spool member 28 comprises a cup-shaped spool portion 59 having an outer cylindrical surface 58, and a pair of outer, axially spaced flanges 60. The lower end of cylindrical, surface 58, and the flanges 60, are respectively, reciprocably guided within central bores 62 and 64 in spacer 38 and in support member 36 respectively. Internally, the cup-shaped spool portion 59 has a bore 66 which retains a compression spring 68. The spring is compressibly interposed between a bottom wall 70 of the spool and an upper surface 72 formed in the switch support member 36. The spring 68 biases the control switch actuating spool member 28 in a downward direction to actuate the switch actuator button 52.

The latch actuating mechanism 30, when latched or reset (FIG. 1), holds the control switch actuating spool member 28 in an upper, reset (untripped) position, and comprises a latching dog 74 and a latching bar 76 physically located in a vertical slot 77 in member 36. The latching dog has a pair of angularly divergent arms 78,80 and is pivoted about a pin 82 secured to member 36. Arm 78 is pointed and engaged within an exterior groove 83 between flanges 60 and moves up and down with control switch actuating spool member 28 between positions shown in FIGS. 1 and 3. Arm 80 is swingable about an arc 84 (FIG. 3) between positions also shown in FIGS. 1 and 3.

Latching bar 76 has a pair of diametrically opposed arms 86,88 and is pivoted about a pin 90 also secured to control switch support member 36. A spring 92, seated within a recess 94 in member 36, engages arm 88 and biases the latching bar clockwise to the latched (reset) position shown in FIG. 1 where the other arm 86 engages the pressure responsive mechanism 32 as will be described.

The latching dog 74, latching bar 76, and pins 82 and 90 may be made of any suitable non-corrosive, non-sticking material, for example, stainless steel Type 303.

The compression spring 68 biases the control switch actuating spool member 28 downwardly causing the upper flange 60 of that spool member to exert a downward force on arm 78 of the latching dog 74. Arm 88 of the latching bar 76 is biased downwardly by the small spring 92. Arm 88 cannot move any farther downwardly than shown in FIG. 1 because the opposite arm 86 engages the underside of a plunger 100 (to be described). Arm 80 of latching dog 74 engages arm 88 of the latching bar, blocking the latching bar from counterclockwise movement. Hence, arm 78 of latching dog 74 holds the switch actuating spool member 28 up (FIG. 1). The high temperature pressure switch assembly will not trip until arm 88 of the latching bar is moved upwardly to the out-of-the way position shown in FIGS. 2 and 3.

The pressure responsive mechanism 32 comprises a flexible main actuating diaphragm 96, an auxiliary diaphragm 97, an upper bushing 98, a lower plunger 100, all positively guided for up and down axial movement, and a diaphragm support plate 43. The upper bushing 98 extends through the outer cover plate 42 so the pressure switch assembly can be manually tested, to replicate operation in response to sudden pressure rise, as will be explained.

One preferred material and specifications for the diaphragm 96 and auxiliary diaphragm 97 may be DuPont "Kapton" plastics film, 5 mils thick, as stated above. Other suitable high temperature materials may be used. Alternatively, a bellows or piston (neither being shown) may be substituted if proper attention is given to minimizing frictional resistance to movement. The diaphragm 96 and auxiliary diaphragm 97 are mounted for movement in an upper space 102 within skirt 46 of control switch support member 36.

The diaphragm support plate 43 has a peripheral portion gripped between the underside of the main actuating diaphragm 96 and the upper skirt 46. It has a central bore 45 and a plurality of through-holes 47. An upwardly concave, conically-dished surface 49 provides clearance for the diaphragms 96,97 to displace downwardly to the tripped position shown in FIG. 3, and provides underside support for the diaphragms in that tripped position.

The lower plunger 100 has an upper, axial extension 104 having external threads 105 engaged with internal threads 106 in bushing 98. The diaphragms 96,97 are annular shaped, having central openings 108 through which the extension 104 is fitted. The central portions of the diaphragms are gripped between the underside of the bushing 98 and an upper flange 110 on the plunger 100.

The auxiliary diaphragm 97 has a smaller outer diameter than the actuating diaphragm 96, terminating at 109 (FIG. 1), therefore the outer portion of the auxiliary diaphragm is not gripped under cover plate 40 as is the case with diaphragm 96. Heat resistance of the pressure switch assembly is important, because very high temperatures can be expected from a methane explosion, a severe electrical arc or pyrolysis of electrical insulation material. The auxiliary diaphragm 97 overlies and protects the main actuating diaphragm 96 from flash and heat entering cover plate openings 40A and 42A, assuring that the assembly will trip reliably.

A spring 112 surrounding the plunger 100 is compressibly interposed between the flange 110 and top surface 114 of control switch support member 36. This biases the entire pressure responsive mechanism 32 upwardly to the reset (untripped) position shown in FIG. 1. Outer surface 116 of bushing 98 is journaled for reciprocable movement within aligned central bores 118, 120 in the cover plates. Likewise, outer surface 122 of plunger 100 is guided within central bore 124 of control switch support member 36.

Figure 3:
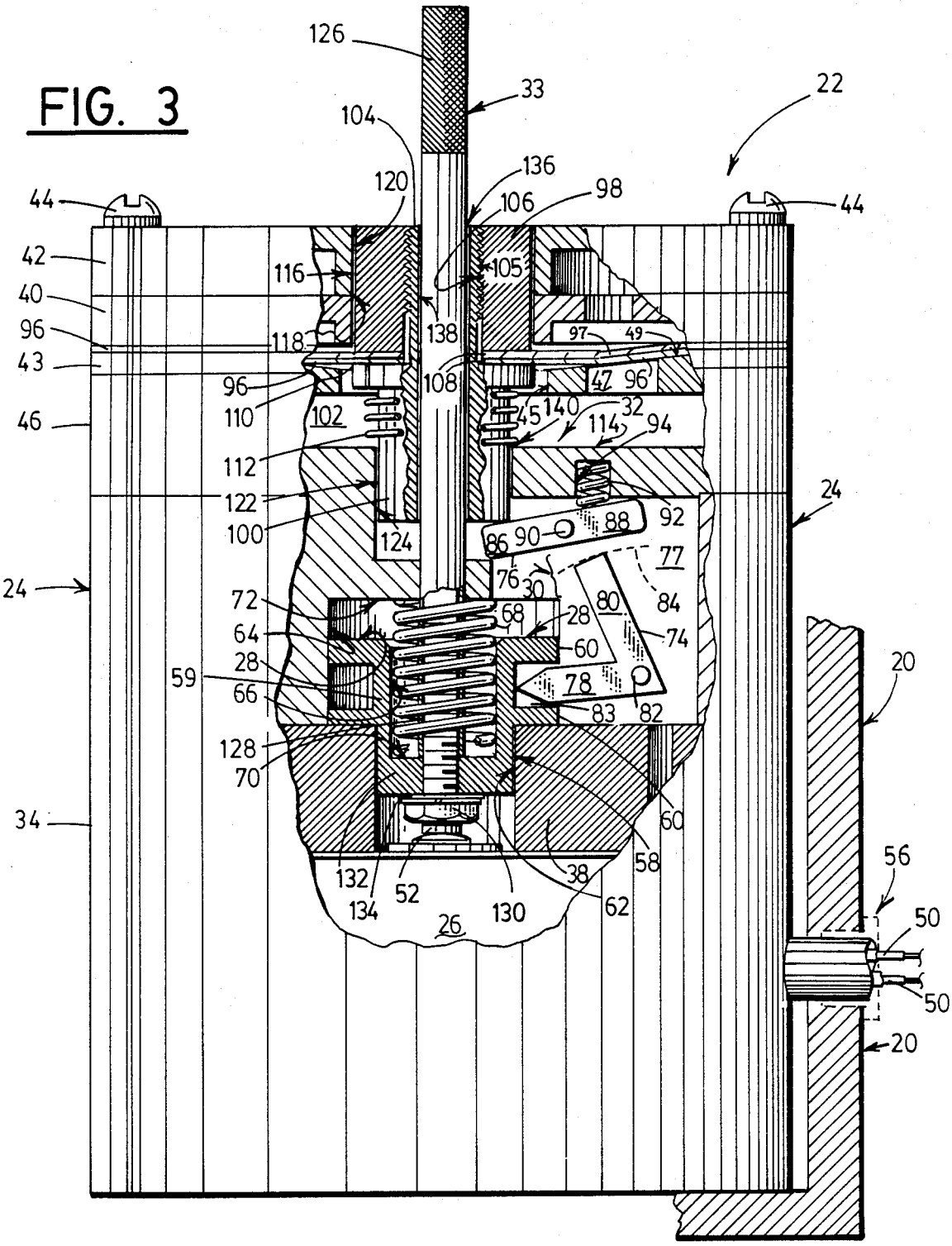
FIG. 3 is a view similar to FIG. 2 showing the switch actuating mechanism in set (tripped) position and the control switch in actuated position.

Reset rod 33 has an external, manually engageable, knurled section 126 and an inner (lower), internally-threaded section 128 threadedly engaged with a bolt 130 extending upwardly through a central bore in bottom wall 132 of control switch actuating spool member 28. A washer 134 and lockwasher 135 are interposed between the head of bolt 130 and the bottom wall 132. The head of bolt 130 engages switch actuator button 52 to actuate the control switch 26 (FIG. 3).

There is a small, but effective, diametrical clearance 136 of about 0.015 inches between the outside diameter of reset rod inner section 128 and the inside diameter of a central bore 138 along the entire length of plunger 100 and its extension 104. Likewise, there is a related annular clearance 140 between the outer surface 122 of plunger 100 and the central bore 124 in member 36. These clearances 136 and 140 are in series and comprise a minor, restricted air inlet port to the inner (lower) face of the diaphragm 96. Air from outside the housing 24 passes downwardly through the clearance 136 into the chamber 77 and then passes upwardly through clearance 140 into chamber 102 into communication with the inner (lower) face of diaphragm 96.

By contrast, the multiple, relatively large openings 40A,42A in the cover plates comprise a major air inlet port communicating directly with the outer (upper) face of the diaphragm 96. A sudden increase in pressure, in the nature of an explosion, within the enclosure 20 would be communicated immediately through auxiliary diaphragm 97 to the outer (upper) face of diaphragm 96 but would be considerably delayed before it is communicated to the inner (lower) face through clearances 136 and 140. This would cause an immediate inward movement of the pressure responsive subassembly 32 to trip the latch actuating mechanism 30 and thereby release control switch actuating spool member 28 causing it to engage button 52 and actuate control switch 26.

On the other hand, low rate barometric pressure changes result in low flow rates of air either into or out of the interior of the pressure switch. This equalizes the internal and external pressures without the differential pressure across the diaphragm becoming sufficient to operate the switch.

OPERATION

Figure 2:
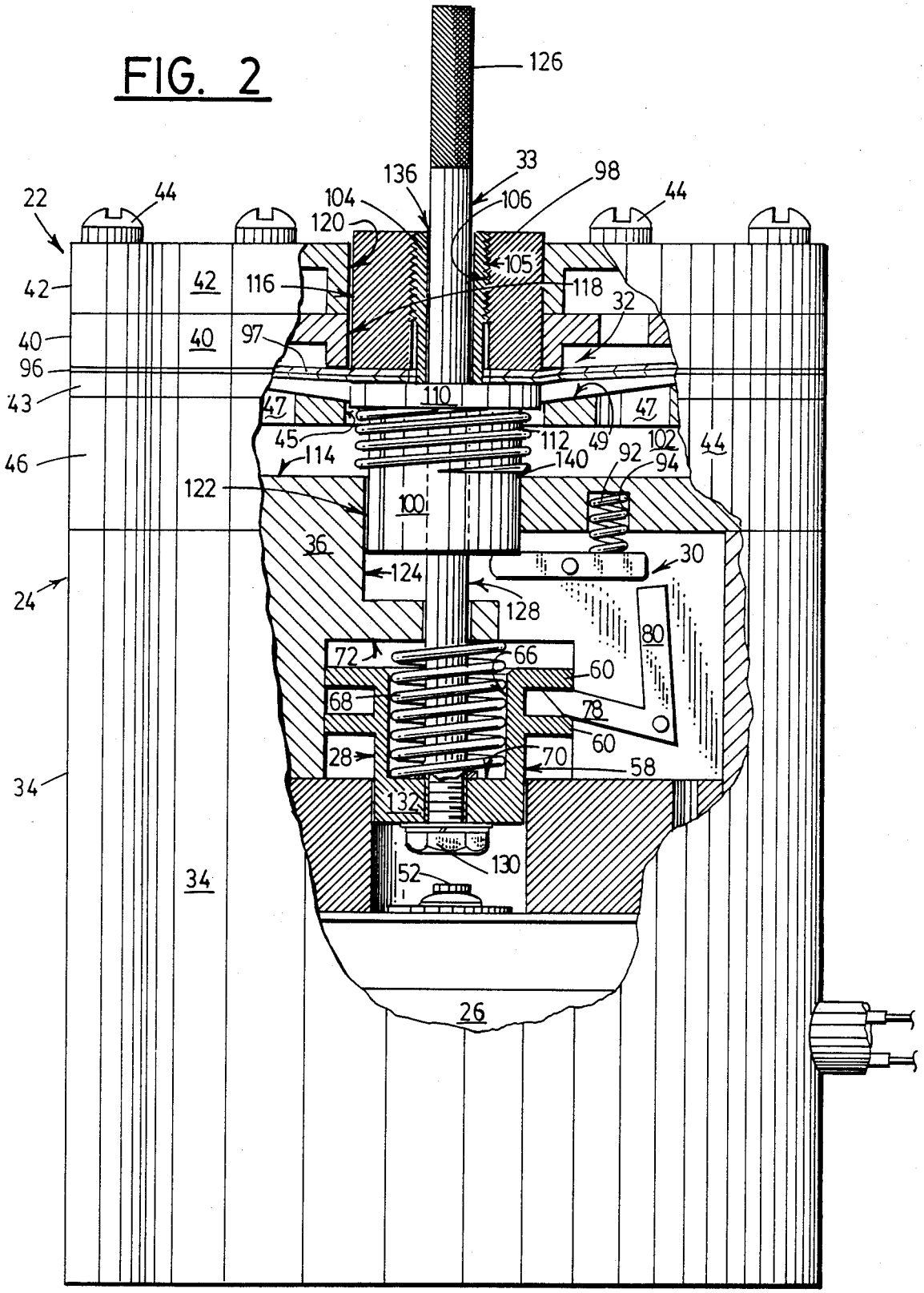
FIG. 2 is a partly-cross-sectioned view similar to FIG. 1, showing the switch-actuating mechanism momentarily after it is tripped and in mid-travel between reset (FIG. 1) and set (FIG. 3) positions.

The basic principle of operation is that an increase in atmospheric pressure causes the diaphragm 96 to deform downwardly in response to a sudden increase in atmospheric pressure within enclosure 20. To prevent it from responding to low rates of atmospheric pressure change, a very small quantity of air is allowed to flow through clearances 136,140 into and out of the cavity 102 beneath the diaphragm. Hence, the pressure increase must be a sudden one, since the clearances 136,140 restrict air from flowing quickly into the cavity beneath the diaphragm 96. The very thin diaphragm (5 mils in this embodiment) deforms under suddenly increased air pressure and exerts downward force on the pressure responsive mechanism 32. If this pressure increase is sufficient to overcome springs 92 and 112, the pressure responsive mechanism 32 (which includes the plunger 100) will move downwardly rocking the latching bar 76 in a counterclockwise direction. When bar 76 rocks sufficiently to disengage arm 80 of latching dog 74 as shown in FIGS. 2 and 3, the control switch actuating spool member 28 will be pushed downwardly by spring 68. The bolt head 130 then actuates the switch 26 by depressing its actuator button 52 as shown in FIG. 3.

FIG. 1 shows the high temperature pressure switch assembly in normal, reset (untripped) position. Spring 112 holds the pressure responsive mechanism 32 in its uppermost position with bushing 98 protruding upwardly through cover plate 42, and with the diaphragm 96 in flattened position against the underside of cover plate 40. Likewise, switch actuating spool member 28 is in its uppermost position, being held in that position by latching dog and bar 74,76 while being urged downwardly by compression spring 68. Latching bar 76 is rocked to its clockwise limit with its arm 88 blocking arm 80 of latching dog 74 which is being urged counterclockwise by the downward pressure of member 28 on arm 78. Hence, arm 78 of latching dog 74 holds the member 28 up. The pressure switch assembly cannot trip until the arm 88 of the latching bar is rocked up out of engagement with arm 80 of the latching dog 74.

Spring 112 supports the weight of the plunger 100 and bushing 98, preventing them from pushing down on arm 86 of the latching bar 76 and inadvertently tripping the pressure switch assembly by vibration or by a relatively low increase in pressure.

A sudden increase in pressure sufficient to overcome springs 112 and 92, will displace the mechanism 32 (including the plunger 100) downwardly, pivoting latching bar 76 to release latching dog 74. This instant in time is shown in FIG. 2. At this moment, the latching dog 74 has just been released by the latching bar 76 and the latching dog is beginning to rock counterclockwise. The switch actuating spool member 28 is just beginning to move downwardly as spring 68 extends. At the next instant, the bolt 130 strikes the switch actuator button 52 and actuates switch 26, as shown in FIG. 3. A signal through conductors 50 opens the remote circuit breaker (not shown) and disables the power supply to the enclosure 20 before the pressure can rise to a dangerous level.

After the pressure switch assembly has tripped and the pressure inside the enclosure 20 returns to normal atmospheric pressure, the diaphragms 96 and 97 return to their "flat" condition (FIG. 1) with the bushing 98 and plunger 100 held up by springs 92 and 112. At this point the spring 92 will return the latching bar 76 to the position it had in the FIG. 1 reset (untripped) condition. However, the latching dog 74 remains in the tripped position shown in FIG. 3 because the control switch actuating spool member 28 is held down by spring 68.

To reset the pressure switch, the reset rod 33 is pulled upwardly. This lifts the control switch actuating spool member 28 against the compression of spring 68. Latching dog 74 rocks clockwise about pin 82. Its arm 80 pushes arm 88 of the latching bar 76 upwardly out of its way. The spring 92 pushes arm 88 back downwardly, causing the pressure switch assembly to latch once again in the reset (untripped) position illustrated in FIG. 1.

Because the reset rod 33 must be pulled upwardly to reset the pressure switch as described above, power to the explosion-proof enclosure cannot be restored until maintenance personnel remove the cover (not shown) of the enclosure 20, providing an opportunity to investigate and correct the problem which caused the internal explosion or sudden pressure rise.

The bushing 98 provides a separate means to test the operating mechanism of the switch, without an increase in atmospheric pressure. The operating mechanism and control switch function exactly as they would in case of an explosive pressure increase in the enclosure 20, when the bushing 98 is pushed downwardly to trip the control switch 26.

The control switch 26 and diaphragms 96 and 97 will preferably be in separate flame-proof compartments. For this purpose, the clearance between the spool surface 58 and bore 62 and the clearance 140 should be of sufficient axial length to quench any hot or flaming gases generated in either compartment.

The invention described and shown has been necessarily specific for purpose of illustration. Alterations, extensions and modifications will be apparent to those skilled in the art. The aim of the appended claims, therefore, is to cover all variations included within the spirit and scope of the invention.

The embodiments of the invention in which an exclusive property or privilege is claimed are defined as follows:

1. A pressure switch assembly responsive to sudden increase in ambient pressure but not responsive to slow or barometric pressure changes comprising:

a housing having therewithin electrical control switch means, control switch actuating means, pressure responsive means, and latch means;

said control switch actuating means being supported for movement to and from a switch actuating position for actuating said control switch means;

first biasing means urging said control switch actuating means toward its said switch actuating position;

said pressure responsive means being separate from and independently movable relative to the control switch actuating means, between tripped and untripped positions; second biasing means urging said pressure responsive means toward its said untripped position;

said housing having a major inlet port providing relatively full flow of ambient air to one face of the pressure responsive member, and a minor inlet port providing relatively restricted flow of ambient air to the opposite face thereof causing said pressure responsive member to move to said tripped position against the urgence of said second biasing means in response to a sudden rise in ambient air pressure but not in response to slow or barometric pressure changes;

said latch means movable to and from a latched position holding said control switch actuating means away from its said switch actuating against the urgence of said first biasing means; and means responsive to movement of said pressure responsive member from untripped to tripped positions to trip said latch means and cause it to release said control switch actuating member for movement by said first spring means to its said switch actuating position.

2. A high temperature pressure switch assembly for an explosion-proof enclosure according to claim 1 in which said pressure responsive means is a diaphragm member with a fixed diaphragm support member in spaced relationship to said opposite face of the diaphragm member, and said diaphragm support member is a foraminous plate having a concave surface engageable with said opposite face of said diaphragm member.

3. A high temperature pressure switch assembly according to claim 1 in which the housing has a pair of spaced-apart cover plates over the pressure responsive member and said major inlet port comprises a plurality of openings in each cover plate, said openings being offset to prevent straight-through access to said pressure responsive member.

4. A high temperature pressure switch assembly for an explosion-proof enclosure for electrical components in hazardous atmospheres comprising:

a housing adapted to be positioned in said enclosure and having therewithin electrical control switch means, control switch actuating means, pressure responsive means, and latch means;

said electrical control switch means having terminal means connectible to control means for a power source supplying electrical power to said enclosure;

said control switch actuating means including a control switch actuating member which is movable between a switch actuating position for actuating said control switch means, and a switch non-actuating position;

first spring means urging said control switch actuating member toward said switch actuating position;

said pressure responsive means including a pressure responsive member which is movable in response to pressure differential across opposite faces thereof;

said housing having a major inlet port providing relatively full flow of ambient air from the interior of the enclosure to one face of the pressure responsive member, and a minor inlet port enabling relatively restricted flow of ambient air to the opposite face thereof causing said pressure responsive member to move from an untripped position to a tripped position in response to a sudden rise in ambient air pressure within the enclosure but not in response to slow or barometric changes;

second spring means urging said pressure responsive member toward its said untripped position;

said latch means being movable to and from a latched position holding said control switch actuating member away from its said switch actuating position; and means responsive to movement of said pressure responsive member from untripped to tripped positions to trip said latch means and cause it to release said control switch actuating member for movement by said first spring means to its said switch actuating position.

5. A high temperature pressure switch assembly according to claim 4 in which said latch means includes means to automatically reset it to its latched position in response to movement of said control switch actuating member to its said switch non-actuating position, and a manually operable reset member extends from the control switch actuating member to a position exteriorly of the housing.

6. A high temperature pressure switch assembly according to claim 5 in which the pressure responsive member and the control switch actuating member are reciprocably movable along a common axis and the reset member comprises a rod extending from outside the housing through an opening in the pressure responsive member and is secured to the control switch actuating member.

7. A high temperature pressure switch assembly according to claim 4 in which:

said latch means includes means to automatically reset itself to its latched position in response to movement of said control switch actuating member to its said switch non-actuating position;

the pressure responsive member and the control switch actuating member are reciprocably movable along a common axis;

a reset rod extends from outside the housing along said axis, through an elongated bore in said pressure responsive member, and is secured to said control switch actuating member; and said minor inlet port comprises an annular clearance passageway between said reset rod and said bore in the pressure responsive member.

8. A high temperature pressure switch assembly according to claim 4 in which:

said housing has a cylindrical bore in one wall thereof;

a bushing secured to and movable with the pressure responsive member is reciprocably slidable within said cylindrical bore and is accessible from the exterior of the housing for testing;

whereby the bushing can be displaced to move the pressure responsive member and thereby simulate movement of the pressure responsive member in response to a sudden rise in ambient air pressure.

9. A high temperature pressure switch assembly according to claim 8 in which:

said latch means includes means to automatically reset itself to its latched position in response to movement of said control switch actuating member to its said switch non-actuating position;

the pressure responsive member and the control switch actuating member are reciprocably movable along a common axis;

a bushing is secured to and movable with the pressure responsive member and is reciprocably slidable within a cylindrical bore in a wall of the housing and is accessible from the exterior of the housing for testing; and a reset rod extends from the exterior of the housing, along said axis, through said bushing, and is secured at its inner end to said control switch actuating member;

whereby the bushing can be displaced from the exterior of the housing to move the pressure responsive member and thereby replicate movement of the pressure responsive member in response to a sudden rise in ambient air pressure; and whereby further, the reset rod can be displaced from the exterior of the housing to move the control switch actuating member to its said switch non-actuating position, and to reset the latch means to its latched positions.

10. A high temperature pressure switch assembly according to claim 8 in which:

said pressure responsive member comprises a flexible diaphragm extending inwardly from the wall of the housing to a plunger which is movable therewith;

said latch means includes a latching dog which is connected for movement with the control switch actuating member and means for blocking said dog from movement to hold the control switch actuating member away from its said switch actuating position; and means is provided responsive to movement of the diaphragm and plunger to unblock said dog and thereby enable said first spring means to move the control switch actuating member to switch actuating position.

11. A high temperature pressure switch assembly according to claim 4 in which:

said pressure responsive member comprises a flexible diaphragm extending radially inwardly from the wall of the housing to a plunger which is movable therewith;

said latch means includes a latching dog which engages the control switch actuating member to hold it in its non-actuating position when the latch means is in its latched position, and a latching trigger bar;

said latching trigger bar being movable to and from a blocking position engaging the latching dog to hold the control switch actuating member in its said switch non-actuating position; and said latch means also includes means for moving the latching trigger bar in response to movement of the plunger to thereby disengage the latching trigger bar from the latching dog and enable the control switch actuating member to be moved to its switch actuating position.

12. A high temperature pressure switch assembly according to claim 11 in which said first spring means acts between the housing and control switch actuating member.

13. High temperature pressure switch apparatus responsive to a sudden increase in ambient pressure and non-responsive to slow changes comprising:

a housing;

an electrical switch having an actuator;

a spool in the housing guided for reciprocable movement between an actuating position engaging the actuator, and a non-actuating position not engaging the actuator;

first spring means urging the spool toward the actuating position;

a latching dog pivotally mounted in the housing, movable between blocking and non-blocking positions, engaging the spool and movable therewith;

a latching bar pivotally mounted in the housing, movable between blocking and non-blocking positions, said latching bar being engageable with the latching dog when the latter is in the blocking position to hold the spool in its non-actuating position;

second spring means biasing the latching bar toward its blocking position;

a plunger axially aligned with the spool along a common axis and guided for separate and independent reciprocable movement along said axis;

a flexible diaphragm connected between the housing and plunger and moveable with the latter between an outer, untripped position and an inner, tripped position;

said housing having a main inlet providing full flow of ambient air to one face of the diaphragm, and an auxiliary inlet providing restricted flow to the opposite face of the diaphragm;

third spring means urging the plunger and diaphragm toward the outer, untripped position; and said plunger being engageable with said latching bar and effective when moved to the inner tripped position to trip the latching bar and move it to the non-blocking position;

whereby, when ambient air pressure rises suddenly, pressure against said one face of the diaphragm moves the plunger to its said tripped position, releases the latching bar from the latching dog, and enables the first spring means to move the spool to its actuating position and actuate the electrical switch.

* * * * *

UNITED STATES PATENT AND TRADEMARK OFFICE

CERTIFICATE OF CORRECTION

PATENT NO. : 4,894,497

DATED : January 16, 1990

INVENTOR(S) : Jennings Lycan

It is certified that error appears in the above-identified patent and that said Letters Patent is hereby corrected as shown below:

In Column 9 line 50 , after "means" insert -- being --.

line 52 , after "actuating" insert -- position --.

line 57 , change "member" to -- means --.

line 58 , delete "by said first spring means".

In Column 11 line 56 , (at the end of claim 9) change "positions" to -- position --.

Signed and Sealed this

Eleventh Day of December, 1990

*Attest:*

HARRY F. MANBECK, JR.

*Attesting Officer*

*Commissioner of Patents and Trademarks*